United States Patent [19]

De Araujo et al.

[11] 4,042,797

[45] Aug. 16, 1977

[54] ELECTRIC SAFETY SWITCH WITH POSITIVE-ACTION MECHANISM

[75] Inventors: Manuel Alexandre Vincent De Araujo, Chamoux-sur-Gelon; Marcel Vouthier, Chateauneuf, both of France

[73] Assignee: Manuel Alexandre Vincent De Araujo, Chamoux-sur-Gelon, France

[21] Appl. No.: 610,396

[22] Filed: Sept. 4, 1975

[30] Foreign Application Priority Data

Sept. 4, 1974 France ..... 74.30949

[51] Int. Cl.[2] ..... H01H 3/00

[52] U.S. Cl. ..... 200/153 R; 200/61.45 M; 200/61.50

[58] Field of Search ..... 200/153 R, 61.45–61.53, 200/277, 161, 238–251, 61.45 M

[56] References Cited

U.S. PATENT DOCUMENTS 3,783,211 1/1974 Panattieri ..... 200/61.5

*Primary Examiner*—Robert K. Schaefer
*Assistant Examiner*—Morris Ginsburg
*Attorney, Agent, or Firm*—Robert E. Burns; Emmanuel J. Lobato; Bruce L. Adams

[57] ABSTRACT

A safety switch has a mobile contact integral with a control lever which is removably held on a switch body in an operative contact-making position by a spring-biased disc. When the lever is tilted in any direction, or axially displaced, cam surfaces of the switch body disengage the lever from the disc to break the circuit, the disc preventing unintentional replacement of the control lever.

7 Claims, 3 Drawing Figures

ELECTRIC SAFETY SWITCH WITH POSITIVE-ACTION MECHANISM

BACKGROUND OF THE INVENTION

SUMMARY OF THE INVENTION

The invention relates to positive-action electric safety switches for breaking electric circuits.

In some known safety switches, a push-button or lever controlling an electric contact can be actuated in certain defined directions over given limited linear or angular paths. These switches are often clumsy to use, and may be dangerous since the contact has a limited movement and accidental movement of the control lever, for example, beyond a limiting position may damage the switch.

In other safety switches, breaking of an electric circuit is achieved by ripping away conducting wires, but these switches are imprecise and resetting can only be carried out by a repair technician, and short-circuits may be produced accidentally by contact of the loose wires with neighbouring metallic masses or bare conductors.

Another type of safety switch relies on the rupture of a rigid element such as a conducting rod or plate, but this involves the necessity of dismantling the switch and replacement of the ruptured element each time the switch is employed.

Finally, safety switches operating by inertia are known, for use in automobiles, wherein a spring-urged ball is held normally in a contactmaking position from which it can be displaced by inertia in the event of a collision. However, these switches are limited to use in vehicles, and are in particular not suitable for applications requiring manual actuation to break the circuit, nor when the switch has to be actuated in response to defined or random movements of a mechanical member.

An object of the invention is therefore to provide an electric safety switch suitable for manual or automatic actuation and which avoids the stated disadvantages.

In general terms, the invention provides a switch having a mobile contact integral with a control lever which is removably held on a switch body in an operative contact-making position. The switch body is arranged with means for positively holding the lever in its contact-making position while allowing removal of the lever in response to tilting in any direction and with any amplitude, or even an axial movement of the lever.

Removal of the lever breaks the circuit, and once removed it can only be replaced by a special manipulation of the holding means which involves a particular sequence and can thus only be done deliberately.

Such a switch can be of simple and robust construction to enable a reliable circuit breaking action by manual or automatic actuation, with no danger of damage to components of the switch.

The means for retaining the lever may include a spring-biased disc a peripheral part of which holds the control lever against two terminals having outflaring conical heads which contact and retain the cylindrical control lever.

The switch body may have cam surfaces ensuring release of said lever in response to tilting of the lever through defined angular paths depending on the direction of tilting.

However, the retaining means could be magnetic, for example a strong permanent magnet on the switch body which attract a ferro-magnetic control rod, the attraction diminishing with the square of the distance separating them, which facilitates removal of the rod in response to tilting thereof. When the control rod is removed, a ferro-magnetic retaining member comes to apply on the permanent magnet to prevent unintentional re-insertion of the control rod. It is thus possible to provide polar pieces which themselves provide electric contacts on the rod, by using ferrites as remanent magnetic material and simultaneously as a ceramic electrical insulator.

BRIEF DESCRIPTION OF THE DRAWINGS

The accompanying drawings show, by way of example, an embodiment of the invention. In the drawings.

DESCRIPTION OF THE PREFERRED EMBODIMENT

Figure 2:
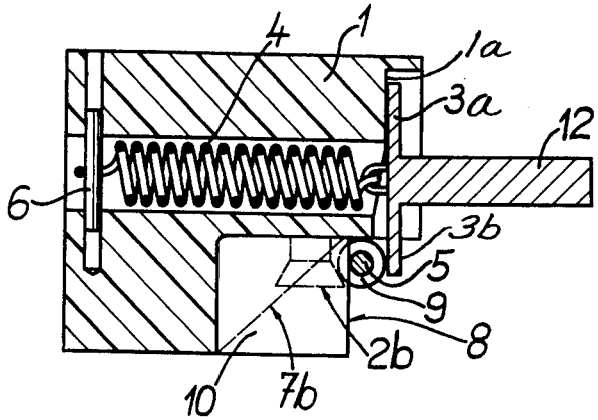
FIG. 2 is a cross-section taken along line II-II of FIG. 1.

The safety switch shown comprises a body 1 of insulating material on which are secured two contact terminals 2*a*, 2*b* each having an outflaring frusto-conical head, visible on FIG. 2 for terminal 2*b*. An extension spring 4 is placed in a through-bore of body 1 and is held at one end by a pin 6. To the other end of spring 4 a disc 3 is attached by its center, whereby the spring pulls disc 3 to apply a top portion 3*a* of the disc against a front surface 1*a* of body 1 and to apply a bottom portion 3*b* of the disc against a removable conducting rod 5. The body 1 also has lateral inclined ramps 7*a* and 7*b* and a central rib 10 with a rounded edge 8, all made integral with the body, as well as recesses (not shown) at appropriate locations, according to the specific application of the switch, to receive bolts or the like for securing the body 1 in place.

The contact terminals 2*a*, 2*b* have axes parallel to surface 1*a* and are so spaced from this surface as to normally hold rod 5, parallel to this surface, as will be clear from the drawings. The terminals include conducting extensions with screws 11*a*, 11*b* for electrically connecting the switch in a circuit.

Rod 5 has parts or extensions 5*a*, 5*b* extending beyond body 1 and ramps 7*a*, 7*b* in the construction and normal position of the rod, as shown. The rod also has a groove 9 adapted to cooperate with the rounded edge 8 of rib 10 to define the single correct position in which rod 5 can be inserted behind disc 3 and held in place by the disc against the two contact terminals 2*a*, 2*b*, adjacent to ramps 7*a*, 7*b* and with the rib 10 of body 1 engaging groove 9 as shown.

Figure 1:
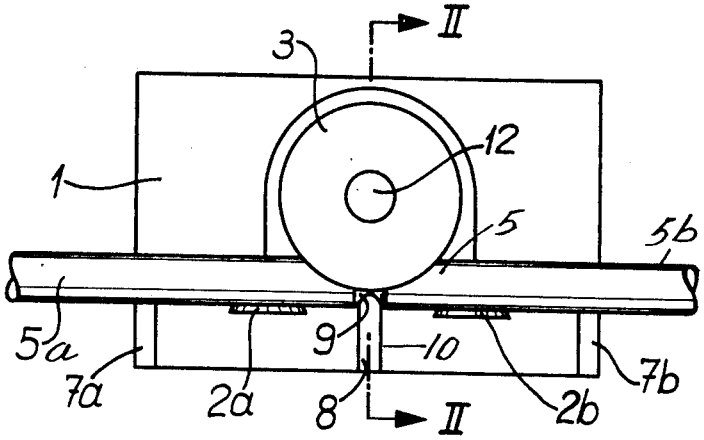
FIG. 1 is a side elevational view of a switch comprising the invention.
Figure 3:
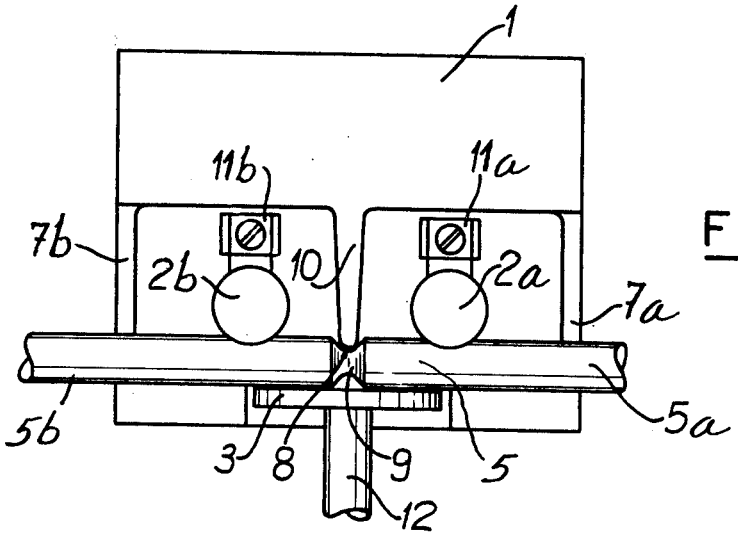
FIG. 3 is a bottom view of the switch of FIG. 1.

When either external force is applied to an extension of the rod 5, either by manual actuation means or by means for automatically displacing the rod, the rod 5 is released and breaks the electric circuit. In the case of an axial displacement along the direction of rod 5, the rounded edge 8 of rib 10 cooperates with the surface of groove 9 to move the rod away from body 1, against the action of spring 4, until the rod 5 is freed from disc 3, which thereafter retracts under the action of spring 4 and prevents unintentional reinsertion of the rod 5 into its operative contact-making position. In the case of a transverse action on either extension 5*a*, 5*b* of rod 5, the rod 5 pivots thus acting as a lever, and is freed. Either the rod 5 pivots in the plane of FIG. 1 with one part bearing on an edge of body 1 adjacent ramp *7a* or *7b*, and another part acting against one of the conical heads of terminals *2a* or *2b* to free rod 5 from disc 3; or the rod 5 pivots in the plane of FIG. 3 and one part comes to bear against and acts against the corresponding ramp *7a* or *7b* to free the rod from disc 3; or pivoting may be oblique and these actions may be combined. The ramps *7a*, *7b*, the rounded edge 8 of rib 10, and the conical heads of terminals *2a* and *2b* thus all act as cam surfaces for diverting the rod during its pivoting to ensure its release from disc 3 after a given angular displacement, which may vary according to the direction of pivoting.

When the rod 5 is released from body 1 it is thus entirely free and may fall. However it may advantageously be retained by suitable means, such as a cord attached to the body 1 and to rod 5, to avoid loss and to facilitate replacement of the rod.

To insert the rod 5 to re-establish the broken circuit, a handle or lever 12 is fitted on disc 3. This lever 12 can be lifted manually, by tipping, against the action of spring 4, to an open position allowing insertion of rod 5 to its contactmaking position. Re-setting of the switch thus involves lifting of lever 12 against a fairly strong spring force and simultaneously placing the rod 5 back up into position as illustrated, with the groove 9 aligned with rib 10. This cannot therefore be doen accidentially or unintentionally.

The rod 5 may, as shown, have two protruding ends *5a*, *5b* either of which may be actuated, or only one long protruding end forming a control lever.

The described switch is useful in many applications, specifically when circuit-breaking must be produced in response to movements of variable amplitude and direction. A particularly interesting application is for the automatic detection of derailing or other mechanical incidents in cable cars when manoeuvered on rails in terminal stations. It can also, generally speaking, be used for the control of limited movements of various mobile pieces, as a manually-actuable safety stopping switch for emergency or alarm use, or as an end-of-path switch to limit movements of defined or random direction and amplitude.

What is claimed is:

1. An electric switch, comprising:

an electrically insulating switch body carrying electric switch terminal means;

an electrically conductive rod disposed to permit movements thereof, along and across and angularly to the extension of the rod, into and out lateral surface contact of the rod with the terminal means;

a retaining member mounted on the switch body and movable between a rod-releasing position and rod-holding position of the member, for releasably holding the rod in said contact in the rod-holding position of the retaining member;

means for elastically biasing the retaining member to its rod-holding position;

manually-actuable handle means releasably engageable for moving the retaining member from the rod-holding to the releasing position to permit manual placing of the rod into said contact, whereby the biasing means positively but releasing maintains said contact when the handle means is released; and means on the switch body defining a bearing surface for lateral contact and cooperation with the rod to release the rod from the holding thereof by the retaining member is response to any of the movements of the rod.

2. A switch according to claim 1, in which the rod has a cylindrical part having an annular groove therein, the switch body having a rib, a surface of which engages in said groove when the rod is in its contact with the terminal means.

3. A switch according to claim 2, in which the groove and the rib surface are curved to facilitate the movement of the rod along its extension in the rod-holding position of the retaining member.

4. A switch according to claim 1, in which the terminal means are first and second terminals, each having a generally conical head for cooperating with the retaining member in holding the rod in the rod-holding position of the member.

5. A switch according to claim 4 in which the retaining member comprises a disc, disposed between the terminals for engagement of a lateral surface of the rod in the rod-holding position of the member.

6. A switch according to claim 1 in which the switch body has a body surface engageable by the retaining member in the rod-holding position of that member; the bearing surface comprising a ramp inclined to said body surface.

7. A switch according to claim 6 additionally including a second, similar ramp disposed on the switch body symmetrically with respect to the terminal means.

* * * * *